US009510641B1

(12) United States Patent
Skinner et al.

(10) Patent No.: US 9,510,641 B1
(45) Date of Patent: Dec. 6, 2016

(54) WATERPROOF BOOT ASSEMBLY

(71) Applicants: Frank Skinner, Gulfport, MS (US); Dara Skinner, Gulfport, MS (US)

(72) Inventors: Frank Skinner, Gulfport, MS (US); Dara Skinner, Gulfport, MS (US)

( * ) Notice: Subject to any disclaimer, the term of this patent is extended or adjusted under 35 U.S.C. 154(b) by 475 days.

(21) Appl. No.: 14/028,155

(22) Filed: Sep. 16, 2013

(51) Int. Cl.

| | |
|---|---|
| ***A43B 5/00*** | (2006.01) |
| ***A43B 7/14*** | (2006.01) |
| ***A43B 23/07*** | (2006.01) |
| ***A43B 7/12*** | (2006.01) |
| ***A43B 3/02*** | (2006.01) |
| ***A43B 23/02*** | (2006.01) |
| *A43B 23/06* | (2006.01) |

(52) U.S. Cl.
CPC . *A43B 7/12* (2013.01); *A43B 3/02* (2013.01); *A43B 23/0235* (2013.01); *A43B 23/06* (2013.01)

(58) Field of Classification Search
CPC ..... A43B 7/12; A43B 3/02; A43B 5/002; A43B 23/02; A43B 23/022; A43B 23/0205; A43B 23/0215; A43B 23/0235; A43B 23/026; A43B 23/06; A43B 23/07
USPC ..... 36/55, 83, 88, 93, 109
See application file for complete search history.

(56) References Cited

U.S. PATENT DOCUMENTS 2,838,854 A * 6/1958 Dosmann ..... A43B 3/02 36/4
3,691,658 A * 9/1972 Di Perno ..... A43B 3/02 36/4
3,823,493 A 7/1974 Brehm et al.
4,022,261 A * 5/1977 Russell ..... A45C 13/08 150/101
4,051,613 A * 10/1977 Collins ..... A43B 5/00 36/114
4,428,089 A * 1/1984 Dawber ..... A43B 5/0405 12/142 R
4,516,336 A * 5/1985 Nissenbaum ..... A43B 3/16 36/7.1 R
4,883,207 A * 11/1989 McArthur ..... A45F 3/04 190/113
4,930,175 A * 6/1990 Chen ..... A43B 7/125 12/142 E
5,526,907 A * 6/1996 Trawick ..... A45C 3/10 190/111
5,729,915 A * 3/1998 Khoo ..... A43B 3/16 36/7.1 R
5,946,822 A * 9/1999 Maturaporn ..... A43B 1/06 36/7.1 R
5,950,333 A 9/1999 Tsen
6,290,114 B1 * 9/2001 Berberian ..... A45F 3/04 224/637

(Continued)

*Primary Examiner* — Anna Kinsaul
*Assistant Examiner* — Jameson Collier

(57) ABSTRACT

A waterproof boot assembly provides waterproof boots that can be collapsed and stored in a storage case while not in use. The assembly includes a boot having an upper end, a lower end, and a perimeter wall extending between the upper and lower ends. The perimeter wall defines a hollow body having the upper end being open. The boot is comprised of a waterproof material. A sole has a top side being attached to the lower end. A first pad is coupled to the boot. The first pad is positioned in and lines the hollow body. A second pad is coupled to the first pad such that the first pad is positioned between the boot and the second pad.

13 Claims, 3 Drawing Sheets

(56) References Cited

U.S. PATENT DOCUMENTS

| | | | | |
|---|---|---|---|---|
| 6,601,743 | B2 * | 8/2003 | Godshaw | A45C 9/00 190/113 |
| 6,698,108 | B2 * | 3/2004 | Pavelescu | A43B 9/02 36/45 |
| 6,923,302 | B2 * | 8/2005 | Godshaw | A45C 13/00 190/109 |
| 7,584,552 | B2 * | 9/2009 | Krauss | A43B 3/16 36/50.1 |
| D623,385 | S | 9/2010 | Stansberry et al. | |
| 7,891,116 | B1 | 2/2011 | Iglikov | |
| 2004/0020077 | A1 * | 2/2004 | Thomas | A43B 7/12 36/4 |
| 2005/0076541 | A1 * | 4/2005 | von Blucher | A43B 1/00 36/113 |
| 2006/0169690 | A1 * | 8/2006 | Rothschild | A45C 7/0036 220/7 |
| 2006/0174517 | A1 | 8/2006 | Chang | |
| 2008/0041098 | A1 * | 2/2008 | Lafauci | A44C 5/022 63/3 |
| 2009/0025252 | A1 | 1/2009 | O'Connor et al. | |
| 2009/0090023 | A1 * | 4/2009 | Rackiewicz | A41D 17/00 36/1.5 |
| 2010/0229429 | A1 * | 9/2010 | Longuet | A43B 7/085 36/3 R |
| 2010/0285283 | A1 * | 11/2010 | Kingsbury | A42B 1/004 428/195.1 |
| 2011/0088280 | A1 * | 4/2011 | Myerscough | A43B 1/0054 36/10 |
| 2011/0119958 | A1 | 5/2011 | Wu | |
| 2012/0171415 | A1 * | 7/2012 | Baychar | A43B 1/0045 428/138 |
| 2014/0075784 | A1 * | 3/2014 | Webb | A43B 3/02 36/109 |

* cited by examiner

WATERPROOF BOOT ASSEMBLY

BACKGROUND OF THE DISCLOSURE

Field of the Disclosure

The disclosure relates to boot assemblies and more particularly pertains to a new boot assembly for providing waterproof boots that can be collapsed and stored in a storage case while not in use.

SUMMARY OF THE DISCLOSURE

An embodiment of the disclosure meets the needs presented above by generally comprising a boot having an upper end, a lower end, and a perimeter wall extending between the upper and lower ends. The perimeter wall defines a hollow body having the upper end being open. The boot is comprised of a waterproof material. A sole has a top side being attached to the lower end. A first pad is coupled to the boot. The first pad is positioned in and lines the hollow body. A second pad is coupled to the first pad such that the first pad is positioned between the boot and the second pad.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
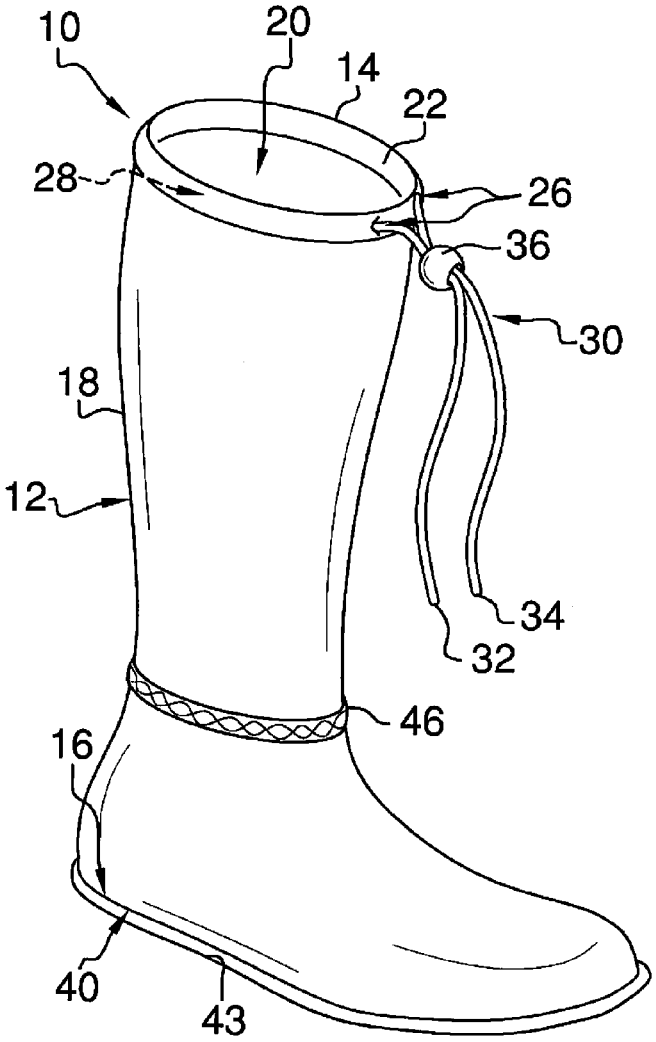
FIG. 1 is a top front side perspective view of a boot of a waterproof boot assembly according to an embodiment of the disclosure.
Figure 7:
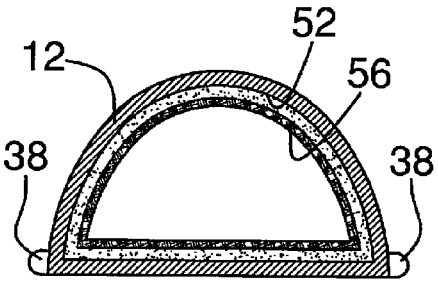
FIG. 7 is a cross-sectional view of an embodiment of the disclosure taken along line 7-7 of FIG. 3.
Figure 2:
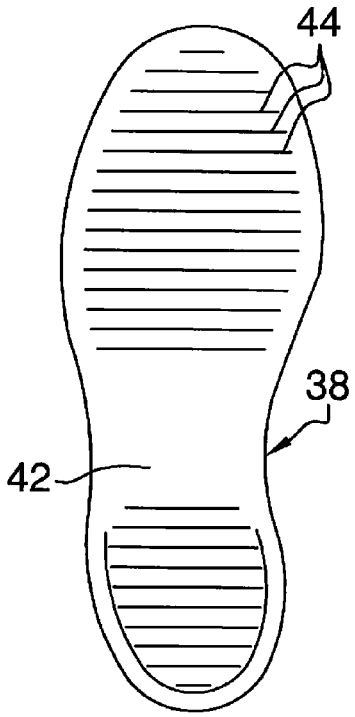
FIG. 2 is a bottom view of a boot of an embodiment of the disclosure.
Figure 3:
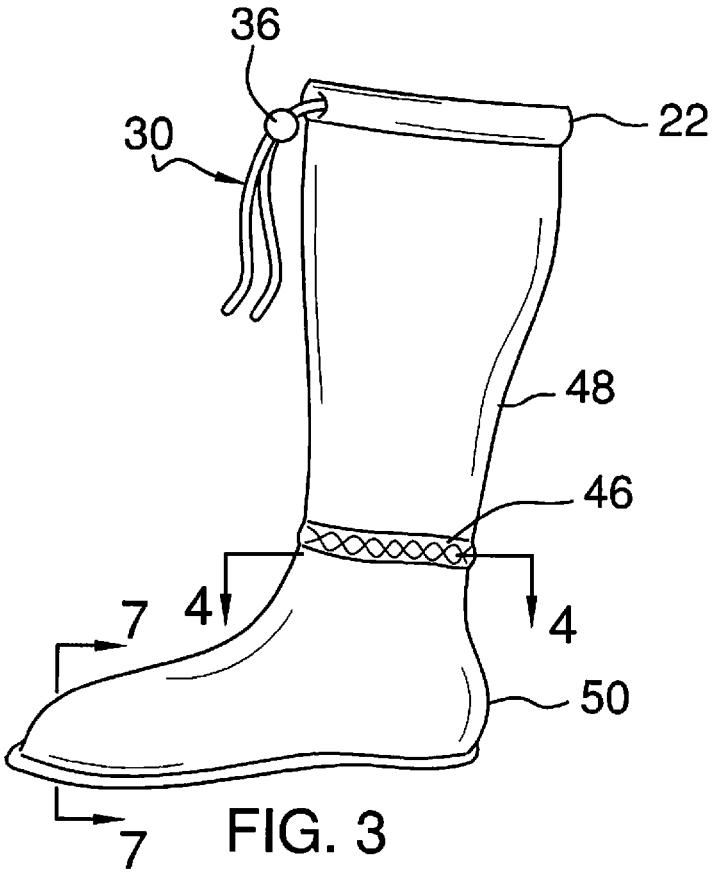
FIG. 3 is a side view of a boot of an embodiment of the disclosure.
Figure 4:
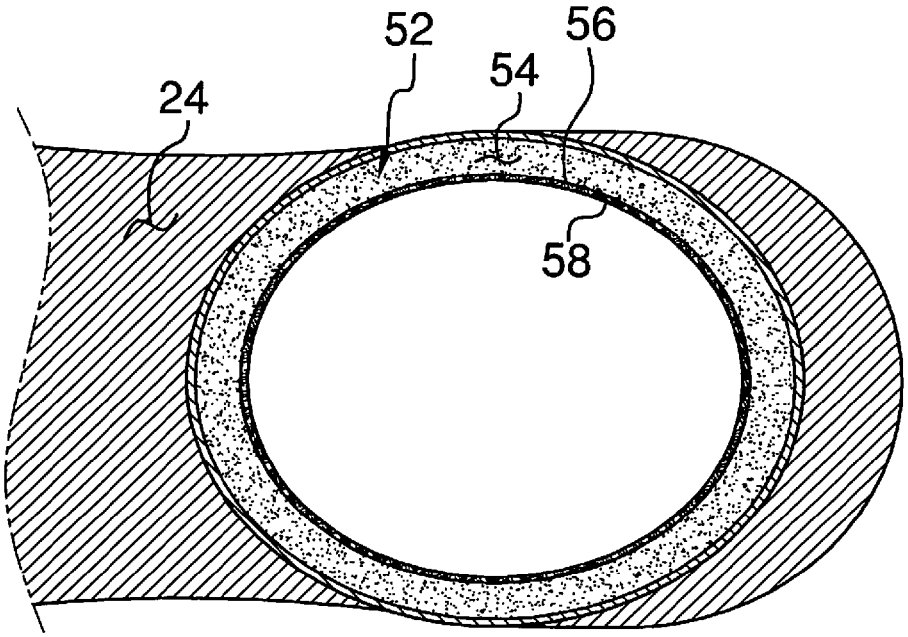
FIG. 4 is a cross-sectional view of an embodiment of the disclosure taken along line 4-4 of FIG. 3.
Figure 5:
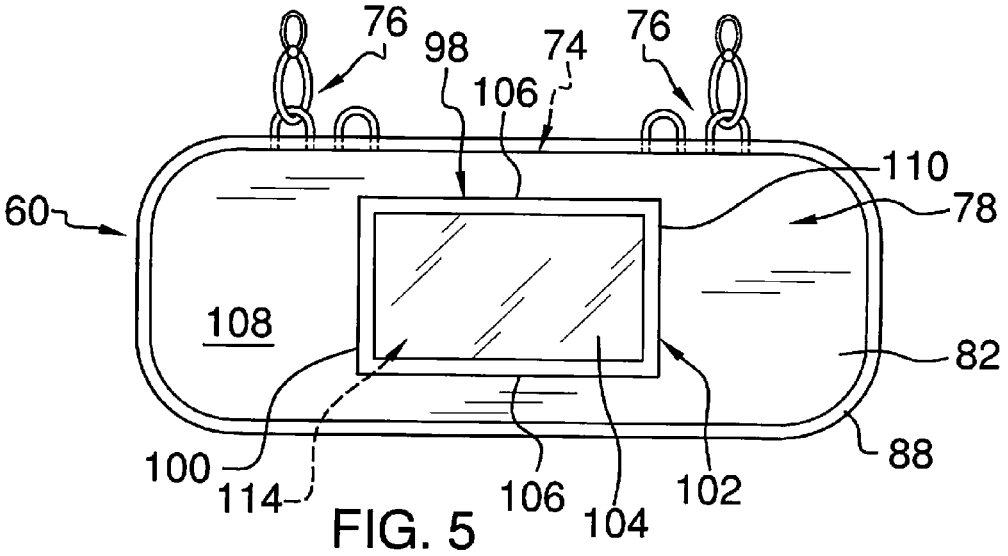
FIG. 5 is a top view of a storage case of an embodiment of the disclosure.
Figure 6:
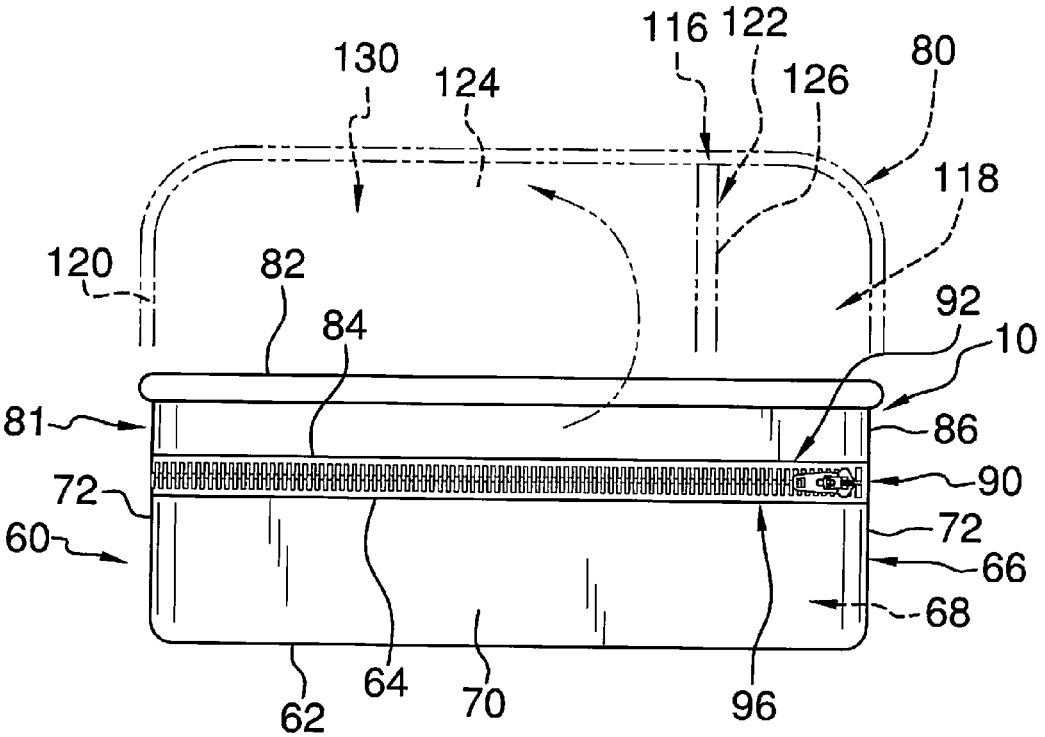
FIG. 6 is a front view of a storage case of an embodiment of the disclosure.

With reference now to the drawings, and in particular to FIGS. 1 through 7 thereof, a new boot assembly embodying the principles and concepts of an embodiment of the disclosure and generally designated by the reference numeral 10 will be described.

As best illustrated in FIGS. 1 through 7, the waterproof boot assembly 10 generally comprises a boot 12 having an upper end 14, a lower end 16, and a perimeter wall 18 extending between the upper 14 and lower 16 ends. The perimeter wall 18 defines a hollow body 20 having the upper end 14 being open. The boot 12 is comprised of a waterproof material 24. The boot 12 may be one of a pair of boots 12.

The upper end 14 includes a top perimeter edge 22 having an enclosed interior 28. A pair of openings 26 is positioned in the top perimeter edge 22 and provides access to the enclosed interior 28. A drawstring 30 extends through the enclosed interior 28 and is configured to cinch the boot 12 around a leg of a user. The drawstring 30 may be comprised of an elastomeric material. The drawstring 30 has a first free end 32 and a second free end 34 each extending outwardly from an associated one of the openings 26. The first free end 32 and the second free end 34 define a first string section 31 and a second string section 33. A ring 36 is positionable over the first 31 and second 33 string sections to couple the first 31 and second 33 string sections together.

A sole 38 is provided and includes a top side 40, a bottom side 42, and an exterior edge 43 extending between the top side 40 and the bottom side 42. The top side 40 of the sole 38 is coupled to the lower end 16 of the boot 12. The sole 38 may be comprised of a resiliently compressible material such as rubber or the like such that the boot 12 is slip-resistant. A plurality of ridges 44 is positioned on the bottom side 42 of the sole 38. The boot 12 may have a height from the sole 38 to the upper end 14 between approximately 20.0 centimeters and 50.0 centimeters. Thus, the boot 12 may be of such a size that the upper end 14 is configured to terminate at an ankle region of the user or may be of a larger size such that the upper end 14 extends over a shin of the user.

A band 46 extends around the perimeter wall 18. The band 46 may be positioned nearer the lower end 16 than the upper end 14 wherein the band 46 is configured to extend around the ankle region of the user. The band 46 defines an upper region 48 and a lower region 50 of the boot 12 wherein the upper region 48 is positioned above the band 46 and the lower region 50 is positioned below the band 46. The lower region 50 terminates at the lower end 16 and does not include the sole 38. The band 46 may be comprised of an elastomeric material wherein the band 46 secures the boot 12 onto a foot of the user. The upper region 48 of the boot 12 may increase in diameter from the band 46 toward the upper end 14.

A first pad 52 is coupled to the boot 12 and positioned in the hollow body 20. The first pad 52 may line both the upper 48 and lower regions 50 of the boot 12 or, alternatively, may line only the lower region 50 of the boot 12. The first pad 52 may comprise an elastomeric material 54, such as memory foam or the like, such that the first pad 52 is configured to conform to a shape of an ankle and foot of the user being pressed against the first pad 52. In this manner, the boot 12 may be form-fitting. A second pad 56 is coupled to the first pad 52 such that the first pad 52 is positioned between the boot 12 and the second pad 56. The second pad 56 may be comprised of terry cloth material 58. Having the first pad 52 and the second pad 56 line only the lower region 50 of the boot 12 permits the boot 12 to collapse down for compact storage.

A storage case 60 has a closed bottom end 62, an open top end 64, and a peripheral wall 66 extending between the open top end 64 and the closed bottom end 62 of the storage case 60. The closed bottom end 62 and the peripheral wall 66 of the storage case 60 define an interior space 68 of the storage case 60 configured to store the boots 12 in a compact manner while not in use. To position the boots 12 entirely within the storage case 60, the boots 12 should first be collapsed. The peripheral wall 66 of the storage case 60 includes a front side 70, a pair of lateral sides 72, and a back side 74. A plurality of hooks 76 is coupled to the storage case 60 wherein the hooks 76 are configured to couple the storage case 60 to a purse, bag, or the like. The hooks 76 may extend outwardly from the back side 74 of the peripheral wall 66 of the storage case 60. The storage case 60 may have a length between approximately 25.0 centimeters and 40.0 centimeters; a width between approximately 8.0 centimeters and 20.0 centimeters; and a depth between approximately 5.0 centimeters and 20.0 centimeters.

A lid 78 is releasably coupled to the storage case 60 wherein the lid 78 is selectively positionable in an opened position 80 to expose the open top end 64 of the storage case 60 or in a closed position 81 to close the open top end 64 of the storage case 60. The lid 78 has a top wall 82, a bottom edge 84, and a peripheral wall 86 extending between the top wall 82 and the bottom edge 84. A slidable fastener 90 may releasably couple the lid 78 to the storage case 60, though other conventional fasteners, such as snaps, hook and loop couplers or the like, may be used instead. The slidable fastener 90 comprises a first set of teeth 92 coupled to the bottom edge 84 of the lid 78 and a second set of teeth 96 coupled to the open top end 64 of the storage case 60. The first set of teeth 92 interlocks the second set of the teeth 96 and closes the open top end 64 of the storage case 60 when the first 92 and second 96 sets of teeth are selectively engaged.

A sleeve 98 is coupled to the lid 78. The sleeve 98 has a closed bottom 100, an open top 102, and a peripheral surface 104 bounded by a pair of lateral sides 106. Each of the peripheral surface 104 and the lateral sides 106 extends between the closed bottom 100 and the open top 102. The closed bottom 100 and the lateral sides 106 may be attached to an exterior surface 108 of the top wall 82 of the lid 78. An outer edge 110 of the open top 102 defines an opening into an interior 114 of the sleeve 98. The peripheral surface 104 may be translucent such that an object stored within the interior 114 of the sleeve 98, such as an identification card or the like, is viewable when positioned within the sleeve 98.

A pocket 116 is also coupled to the lid 78. The pocket 116 may be positioned on an interior surface 118 of the top wall 82 of the lid 78. The pocket 116 has a closed bottom end 120, an open top end 122, and a perimeter wall 124 extending between the closed bottom end 120 and the open top end 122 of the pocket 116. A peripheral edge 126 of the open top end 122 of the pocket 116 defines an access opening into an interior 130 of the pocket 116. The interior 130 of the pocket 116 is configured to store a plastic bag or the like that can be positioned around the boots 12 after the boots 12 are worn in inclement weather. This allows the bag to protect the storage case 60 from becoming wet when the boots 12 are placed inside the storage case 60.

In use, as stated above and shown in the Figures, a user wears the boot 12, or pair of boots 12, when inclement weather is expected. The drawstring 30 is manipulated to cinch each boot 12 securely around a leg of the user. After being used, the boots 12 are collapsed in order to stow the boots 12 in the storage case 60. The sleeve 98 is used to store a user's identification card or the like, while the pocket 116 is used to store a bag. The bag is positioned around the boots 12 after the boots 12 are worn in inclement weather so as to prevent the storage case 60 from becoming wet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A waterproof boot assembly comprising:

a boot having an upper end, a lower end, and a perimeter wall extending between said upper and lower ends, said perimeter wall defining a hollow body having said upper end being open, said boot being comprised of a waterproof material, said upper end including a top perimeter edge having an enclosed interior, wherein said boot is collapsible;

a sole having a top side being attached to said lower end;

a first pad coupled to said boot, said first pad being positioned in and lining said hollow body;

a second pad coupled to said first pad such that said first pad is positioned between said boot and said second pad;

a pair of openings positioned in said top perimeter edge, said openings providing access to said enclosed interior;

a drawstring extending through said enclosed interior wherein said drawstring is configured to cinch said boot around a leg of a user, said drawstring having a first free end and a second free end each extending outwardly from an associated one of said openings;

a storage case having a closed bottom end, an open top end, and a peripheral wall extending between said open top end and said closed bottom end of said storage case, said closed bottom end and said peripheral wall of said storage case defining an interior space of said storage case configured to store said boot when said boot is collapsed downwardly and positioned within said storage case;

a lid releasably coupled to said storage case wherein said lid is selectively positionable in an opened position to expose said open top end of said storage case or in a closed position to close said open top end of said storage case; and a sleeve coupled to said lid, said sleeve having a closed bottom, an open top, and a peripheral surface bounded by a pair of lateral sides, each of said peripheral surface and said lateral sides extending between said closed bottom and said open top, said closed bottom and said lateral sides being attached to an exterior surface of a top wall of said lid, an outer edge of said open top defining an opening into an interior of said sleeve wherein said interior is configured to hold an identification card of the user, said sleeve being translucent.

2. The assembly of claim 1, further comprising:

said first free end and said second free end defining a first string section and a second string section; and a ring positionable over said first string section and said second string section to couple said first and second string sections together.

3. The assembly of claim 1, further comprising a plurality of ridges positioned on a bottom side of said sole.

4. The assembly of claim 1, further comprising a band extending around said perimeter wall, said band being positioned nearer said lower end than said upper end wherein said band is configured to extend around an ankle region of a user, said band defining an upper region and a lower region of said boot wherein said upper region is positioned above said band and said lower region is positioned below said band and terminates at said lower end.

5. The assembly of claim 4, further comprising said band being comprised of an elastomeric material wherein said band is configured to secure said boot onto a foot of a user.

6. The assembly of claim 4, further comprising said upper region of said boot increasing in diameter from said band toward said upper end.

7. The assembly of claim 4, further comprising said first pad lining said lower region of said boot.

8. The assembly of claim 1, further comprising said first pad comprising an elastomeric material such that said first pad is configured to conform to a shape of a foot and ankle of a user being pressed against said first pad when said boot is worn by the user.

9. The assembly of claim 1, further comprising said second pad being comprised of terry cloth material.

10. The assembly of claim 1, further comprising a slidable fastener releasably coupling said lid to said storage case, said slidable fastener comprising a first set of teeth coupled to a bottom edge of said lid and a second set of teeth coupled to said open top end of said storage case, said first set of teeth interlocking said second set of said teeth and closing said open top end of said storage case when said first and second sets of teeth are selectively engaged.

11. The assembly of claim 1, further comprising a pocket coupled to said lid, said pocket being positioned on an interior surface of said top wall of said lid, said pocket having a closed bottom end, an open top end and a perimeter wall extending between said closed bottom end and said open top end of said pocket, a peripheral edge of said open top end of said pocket defining an access opening into an interior of said pocket, said interior of said pocket being configured to store a bag for positioning around said boot after said boot is worn in inclement weather.

12. The assembly of claim 1, further comprising a plurality of hooks coupled to said storage case wherein said hooks are configured to couple said storage case to a purse.

13. A waterproof boot assembly comprising:

a boot having an upper end, a lower end, and a perimeter wall extending between said upper and lower ends, said perimeter wall defining a hollow body having said upper end being open, said upper end including a top perimeter edge, said boot being comprised of a waterproof material;

a pair of openings positioned in said top perimeter edge having an enclosed interior, said openings providing access to said enclosed interior;

a drawstring extending through said enclosed interior wherein said drawstring is configured to cinch said boot around a leg of a user, said drawstring having a first free end and a second free end each extending outwardly from an associated one of said openings, said first free end and said second free end defining a first string section and a second string section, said drawstring being comprised of an elastomeric material;

a ring being positionable over said first and second string sections to couple said first and second string sections together;

a sole including a top side, a bottom side, and an exterior edge extending between said top side and said bottom side, said top side being coupled to said lower end of said boot, said sole being comprised of a resiliently compressible material;

a plurality of ridges positioned on said bottom side of said sole;

a band extending around said perimeter wall, said band being positioned nearer said lower end than said upper end wherein said band is configured to extend around an ankle region of a user, said band defining an upper region and a lower region of said boot wherein said upper region is positioned above said band and said lower region is positioned below said band and terminates at said lower end, said band being comprised of an elastomeric material wherein said band is configured to secure said boot onto a foot of a user;

wherein said upper region of said boot increases in diameter from said band toward said upper end;

a first pad coupled to said boot and positioned in said hollow body, said first pad lining said lower region of said boot, said first pad comprising memory foam such that said first pad is configured to conform to a shape of an ankle and foot of the user being pressed against said first pad when said boot is worn by the user;

a second pad coupled to said first pad such that said first pad is positioned between said boot and said second pad, said second pad being comprised of terry cloth material;

wherein said assembly further comprises a second instance of said boot;

a storage case having a closed bottom end, an open top end, and a peripheral wall extending between said open top end and said closed bottom end of said storage case, said closed bottom end and said peripheral wall of said storage case defining an interior space of said storage case configured to store said boots when said boots are collapsed downwardly and positioned within said storage case, said peripheral wall including a front side, a pair of lateral sides and a back side;

a lid releasably coupled to said storage case wherein said lid is selectively positionable in an opened position to expose said open top end of said storage case or in a closed position to close said open top end of said storage case, said lid having a top wall, a bottom edge and a peripheral wall extending between said top wall and said bottom edge;

a slidable fastener releasably coupling said lid to said storage case, said slidable fastener comprising a first set of teeth coupled to said bottom edge of said lid and a second set of teeth coupled to said open top end of said storage case, said first set of teeth interlocking said second set of said teeth and closing said open top end of said storage case when said first and second sets of teeth are selectively engaged;

a sleeve coupled to said lid, said sleeve having a closed bottom, an open top and a peripheral surface bounded by a pair of lateral sides, each of said peripheral surface and said lateral sides extending between said closed bottom and said open top, said closed bottom and said lateral sides being attached to an exterior surface of said top wall of said lid, an outer edge of said open top defining an opening into an interior of said sleeve wherein said interior is configured to hold an identification card of the user, said peripheral surface of said sleeve being translucent;

a pocket coupled to said lid, said pocket being positioned on an interior surface of said top wall of said lid, said pocket having a closed bottom end, an open top end and a perimeter wall extending between said closed bottom end and said open top end of said pocket, a peripheral edge of said open top end of said pocket defining an access opening into an interior of said pocket, said interior of said pocket being configured to store a plastic bag for positioning around said boots after said boots are worn in inclement weather; and a plurality of hooks coupled to said storage case wherein said hooks are configured to couple said storage case to a purse, said hooks extending outwardly from said back side of said peripheral wall of said storage case.

* * * * *